United States Patent [19]

Nusair et al.

[11] Patent Number: 4,878,061

[45] Date of Patent: Oct. 31, 1989

[54] BROADBAND WIDE FLARE RIDGED MICROWAVE HORN ANTENNA

[75] Inventors: Marwan E. Nusair; Michael D. Valentine; Stephen R. Scholl, all of Cincinnati, Ohio

[73] Assignee: Valentine Research, Inc., Cincinnati, Ohio

[21] Appl. No.: 275,973

[22] Filed: Nov. 25, 1988

[51] Int. Cl.[4] ..... H01Q 13/02

[52] U.S. Cl. ..... 343/786; 343/772

[58] Field of Search ..... 343/786, 772

[56] References Cited

U.S. PATENT DOCUMENTS

| | | | |
|---|---|---|---|
| 2,825,060 | 2/1958 | Ruze | 343/786 |
| 3,173,146 | 3/1965 | Carson | 343/786 |
| 3,566,309 | 2/1971 | Ajioka | 343/786 |
| 4,021,814 | 5/1977 | Kerr et al | 343/786 |
| 4,201,956 | 5/1980 | Kienberger et al. | 343/786 |
| 4,210,915 | 7/1980 | Kienberger et al. | 343/786 |
| 4,531,131 | 7/1985 | Monser | 343/786 |
| 4,571,593 | 2/1986 | Martinson | 343/783 |
| 4,630,062 | 12/1986 | Dewey | 343/786 |
| 4,658,267 | 4/1987 | Roy et al. | 343/786 |
| 4,672,384 | 6/1987 | Roy et al. | 343/786 |
| 4,673,946 | 6/1987 | Hoover | 343/776 |

OTHER PUBLICATIONS

K. L. Walton & V. C. Sundberg, "Broadband Ridged Horn Design," Microwave Journal, vol. 7, pp. 96–101, Mar. 1964.

J. R. Pyle, "The Cutoff Wavelength of the $TE_{10}$ Mode in Ridged Rectangular Waveguide of Any Aspect Ratio, " IEEE Transactions on Microwave Theory and Techniques, vol. MTT-14, No. 4, Apr. 1966.

James P. Montgomery, "On the Complete Eigenvalue Solution of Ridged Waveguide," IEEE Transactions on Microwave Theory and Techniques, vol. MTT-19, No. 6, Jun. 1971.

*Primary Examiner*—Rolf Hille

*Assistant Examiner*—Michael C. Wimer

*Attorney, Agent, or Firm*—Killworth, Gottman, Hagan & Schaeff

[57] ABSTRACT

A fast-flared horn antenna for use in a microwave detector comprises an upwardly flared top wall, a downwardly flared bottom wall, and outwardly flared side walls extending between the top wall and the bottom wall. The curvature and the first derivative of the curvature of the flares of the top, bottom and side walls are continuous. Flared and vanishing first and second ridges are formed into the bottom wall and the top wall respectively, the curvature and the first derivative of the curvature of the flares of the first and second ridges are also continuous and sized such that the first and second ridges vanish into the bottom and top walls and the side walls at the same plane. The horn antenna may be sized such that the ridges vanish at the front edge of the aperture of the horn antenna or the ridges may vanish within the horn antenna. If the ridges vanish within the horn antenna, the length of the horn antenna extending beyond the vanishing plane of the ridges is sized to introduce a phase delay which is substantially equal but opposite to the phase error introduced by the ridged portion of the horn antenna to thereby compensate for phase errors in the horn antenna.

9 Claims, 2 Drawing Sheets

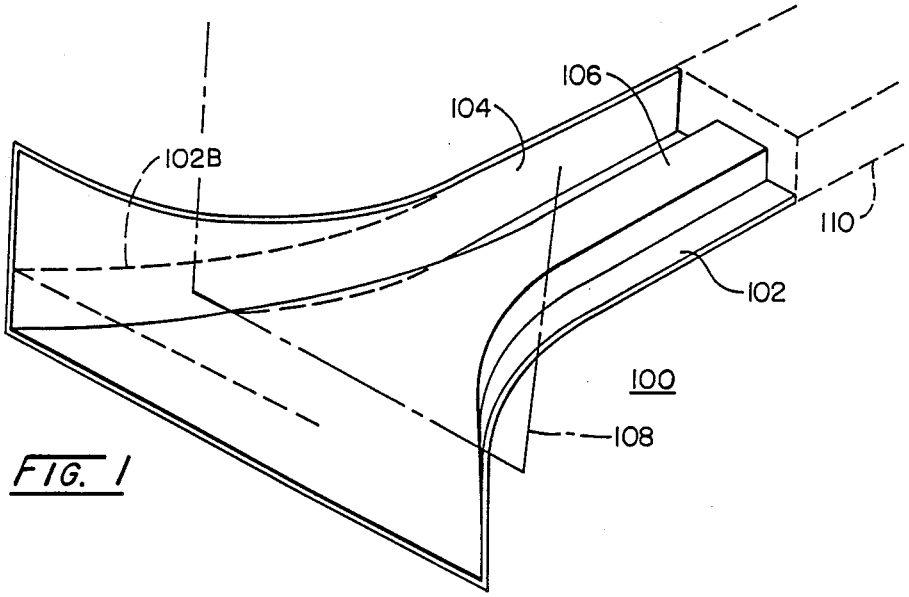
FIG. 1
FIG. 4
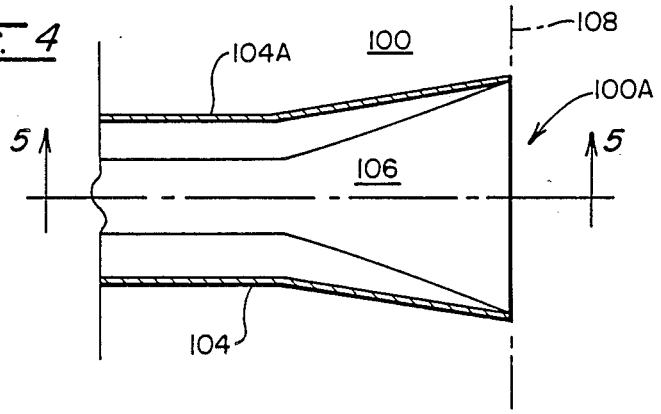
FIG. 5
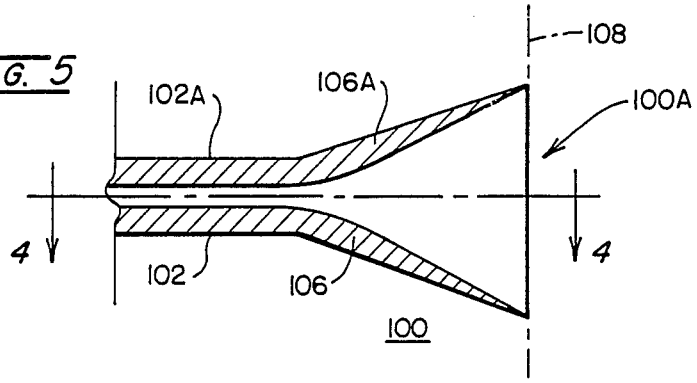

BROADBAND WIDE FLARE RIDGED MICROWAVE HORN ANTENNA

BACKGROUND OF THE INVENTION

The present invention relates generally to microwave antennas and, more particularly, to a fast-flared ridged microwave horn antenna which operates over a wide frequency bandwidth and is particularly applicable for use in microwave radar detectors.

Microwave radar detectors are popular automotive accessories, particularly now when speed limits are moving up but still held to 55 and 65 miles per hour, and more powerful, faster cars are having a resurgence in view of reduced oil and gasoline prices. Due to consumer preference for small package size, the most popular radar detectors are approximately ¾ of an inch in height and 2½inches in width or less. Such small dimensions are hard to achieve since, as is well known in the art, it is difficult to design a microwave antenna having high directivity over a wide frequency bandwidth if the height of the aperture of the antenna is to be limited. While flared antennas have been used for radar detectors to achieve small package size, high aperture efficiency is difficult to obtain with a large flare angle due to high phase error losses which are incurred in such antennas. Adding to the design difficulties is the recent expansion of the frequency bands which are available for operation of police speed detection radar: such bands now include the X, Ku, K and Ka bands which range from approximately 10 to 35 GHz.

Accordingly, there is a need for a compact microwave antenna for use in state-of-the art microwave radar detectors which can effectively cover the frequency bands now or soon to be employed by police speed detection radars while satisfying consumer demands for small sized radar detectors.

SUMMARY OF THE INVENTION

This need is met by the present invention wherein a fast-flared horn antenna includes outwardly flared side walls and outwardly flared top and/or bottom walls which include a single or double ridge structure which flares out to a rectangular aperture. The ridge(s) flare out at a greater rate than the flare of the sidewalls as the ridge(s) height decreases such that the ridge(s) disappear into the side walls and top and/or bottom walls at the same point. Such flaring of the ridge(s) produces a phase delay across the antenna aperture which substantially compensates for the phase error loss introduced by a horn antenna having a large flare angle. The curvature and the first derivative of the curvature of the flares of both the walls and the ridge(s) are continuous such that the fields on opposite sides of any cross-sectional plane taken along the horn antenna match one another. The height of the ridge(s) also taper exponentially from the point of origin to the vanishing point to produce a smoothly transitioning impedance profile along the horn antenna.

In accordance with one aspect of the present invention, a fast-flared horn antenna for use in a microwave detector comprises an upwardly flared top wall, a downwardly flared bottom wall and outwardly flared side walls extending between the top wall and the bottom wall. The curvature and the first derivative of the curvature of the flares of the top, bottom and side walls is continuous. A flared and vanishing first ridge is formed into the bottom wall, the curvature and the first derivative of the curvature of the flare of the first ridge being continuous and sized such that the first ridge vanishes into the bottom wall and the side walls at the same plane.

The fast-flared horn antenna may further comprise a flared and vanishing second ridge formed into the top wall. The curvature and the first derivative of the curvature of the flare of the second ridge are also continuous and sized such that the second ridge vanishes into the top wall and the side walls at the same plane. The heights of the first and second ridges preferably follow an exponential taper from their origination adjacent the launching waveguide at the back of the antenna to the vanishing plane of the ridges. The ridges may vanish at the frontal edge of the aperture of the horn antenna, or the ridges may vanish within the horn antenna. If the ridges vanish within the horn antenna, the length of the horn antenna extending beyond the vanishing plane of the ridges is sized to introduce a differential phase delay which is substantially equal but opposite to the phase error introduced by the ridged portion of the horn antenna to thereby compensate for phase errors in the horn antenna.

In accordance with another aspect of the present invention, a fast-flared horn antenna for use in a microwave detector comprises a flat top wall, a downwardly flared bottom wall and outwardly flared side walls extending between the top wall and the bottom wall. The curvature and the first derivative of the curvature of the flares of the bottom and side walls are continuous, and a flared and vanishing first ridge is formed into the bottom wall. The curvature and the first derivative of the curvature of the flare of the first ridge are also continuous and the first ridge is sized such that it vanishes into the bottom wall and the side walls at the same plane. The height of the first ridge preferably follows an exponential taper from its origination adjacent to the launching waveguide at the back of the antenna to its vanishing plane. The first ridge may vanish at the frontal edge of the aperture of the horn antenna or the first ridge may vanish within the horn antenna. If the first ridge vanishes within the horn antenna, the length of the horn antenna extending beyond the vanishing plane of the first ridge is sized to introduce a phase delay which is substantially equal but opposite to the phase error introduced by the ridged portion of the horn antenna to thereby compensate for phase errors in the horn antenna.

It is therefore an object of the present invention to provide a compact microwave antenna for use in state-of-the art microwave radar detectors which can effectively cover frequency bands now or soon to be employed by police speed detection radars; and, to provide a compact microwave antenna for use in state-of-the art microwave radar detectors by means of a fast-flared horn antenna comprising a downwardly flared bottom wall, an upwardly flared top wall and outwardly flared side walls extending between the bottom wall and the top wall including flared and vanishing first and second ridges formed into the bottom and top walls, the curvature and the first derivative of the curvature of the flares of the bottom wall, top wall, side walls, and first and second ridges being continuous and sized such that the first and second ridges vanish into the bottom wall, top wall and the side walls at the same plane.

Other objects and advantages of the invention will be apparent from the following description, the accompanying drawings and the appended claims.

BRIEF DESCRIPTION OF THE DRAWINGS

FIG. 1 is a perspective view of a bottom wall and one side wall of a first embodiment of a microwave horn antenna in accordance with the present invention;

FIGS. 4 and 5 are cross sectional top and side views taken along the section lines 4—4 and 5—5, of a second embodiment of a microwave horn antenna in accordance with the present invention.

DETAILED DESCRIPTION OF THE INVENTION

Figure 2:
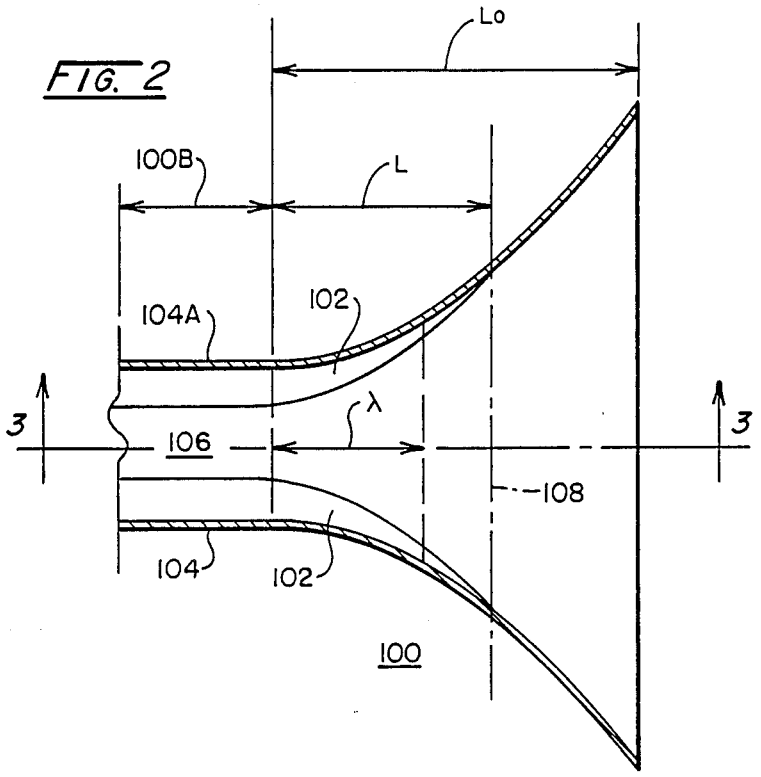
FIGS. 2 and 3 are cross sectional top and side views of the antenna of FIG. 1 taken along the section lines 2—2 and 3—3.

FIG. 1 is a perspective view of a first embodiment of a microwave horn antenna 100 in accordance with the present invention or, more accurately, a flared bottom wall 102 and one flared side wall 104 of the antenna 100. A top wall 102A, see FIGS. 3 and 5, of the antenna 100 is the same as the bottom wall 102 but inverted, and the other side wall 104A, see FIGS. 2 and 4, is the same as the side wall 104 but also inverted. Only the bottom wall 102 and the side wall 104 are shown in FIG. 1 in the interest of clarity and for ease of description.

The bottom wall 102 includes a flared and vanishing first ridge 106 formed thereinto. The bottom, top and side walls 102, 102A, 104, 104A are formed such that the curvature and the first derivative of the curvature of their flares are continuous. The flared and vanishing first ridge 106 is also formed such that the curvature and the first derivative of the curvature of its flare are continuous. However, the first ridge is sized such that its width increases at a faster rate than the width of the embedding antenna. Due to this difference in sizing, the first ridge 106 vanishes into the bottom wall 102 and the side walls 104 and 104A at the same point or plane 108, see FIGS. 1, 2 and 3. For a single ridge antenna, the wall opposite the ridge also may be a flat conducting plane, as shown by the dotted line partial plane 102B (top wall) shown in FIG. 1.

Figure 3:
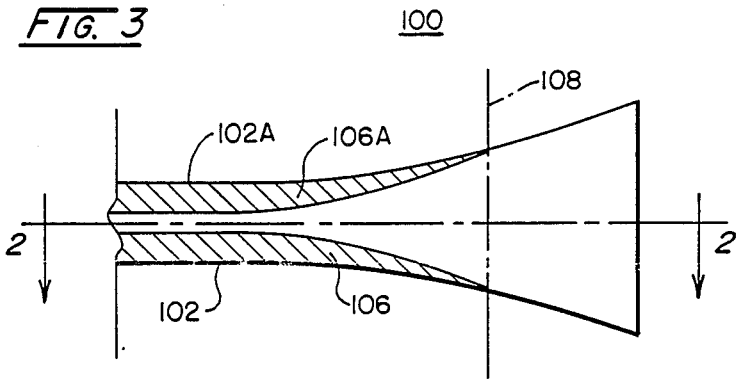

The fast-flared horn antenna 100 may further comprise a flared and vanishing second ridge 106A formed into the top wall 102A, see FIGS. 3 and 5. The curvature and the first derivative of the curvature of the flare of the second ridge 106A is also continuous and sized such that the second ridge 106A vanishes into the top wall 102A and the side walls 104, 104A at the same point or plane 108. To prevent over-mode generation in the body of the horn antenna 100 and to minimize reflected power, the first and/or second ridges 106, 106A are formed such that the impedance of the antenna 100 follows an exponential taper from the back of the antenna where it matches in value and in rate of change the impedance of a launching waveguide 110, to the point or plane 108 at which the ridge(s) 106, 106A melds or vanishes into the walls 102, 102A, 104, 104A of the antenna 100 where the impedance is also matched both in value and in rate of change. As shown in FIG. 3, the impedance taper is such that the ridge gap for the antenna 100 flares out, increasing to the point of becoming equal to the full height of the embedding antenna and thereby vanishing into the walls of the embedding antenna. This formation of the ridge(s) 106, 106A results in a substantially perfect match of the field configurations at any cross sectional plane taken along the antenna 100, such as the plane 108.

The vanishing point or plane 108 of the ridges 106, 106A may be at the frontal edge 100A of the aperture of the horn antenna 100 as shown in FIGS. 4 and 5. Alternately, the ridges 106, 106A may vanish within the horn antenna 100 as shown in FIGS. 1, 2 and 3. If the ridges 106, 106A vanish within the horn antenna 100, the length of the horn antenna 100 extending beyond the vanishing point or plane 108 of the ridges 106, 106A is sized to introduce a phase delay which is substantially equal but opposite to the phase error introduced by the ridged portion of the horn antenna 100 to thereby compensate for phase errors in the horn antenna 100.

An analysis of the wavefronts in the horn antenna 100 from the launching waveguide at the back of the antenna 100 to the vanishing point or plane 108 of the ridges 106, 106A shows that the wavefronts develop smoothly from planar surfaces at the back (although with highly nonuniform amplitude cross sections typical of ridged waveguides), to distorted curved surfaces in the body of the antenna 100, and finally to a slightly distorted concave surface at the plane in which the ridges vanish. Extension of the antenna 100 beyond the plane 108 with the same flare but with no ridges, introduces a distortion of the wavefronts which reduces their concavity. At one extension length, the wavefronts become very nearly planar. This extension length is optimum for the antenna and results in the highest possible aperture efficiency and directivity. Any further extension of the length of the antenna will cause the wavefronts to become convex again resulting in increased phase errors.

In the case of a horn antenna 100 with a smaller flare angle as shown in FIGS. 4 and 5, the vanishing point or plane 108 of the ridges 106, 106A can be selected as the plane or point at which the wavefronts become nearly planar. For this embodiment of the antenna 100, no further extension of the length of the antenna is possible without degrading the aperture efficiency.

Attempts to correct phase error losses in microwave antennas have typically introduced impedance discontinuities, giving rise to the generation of higher-order modes of propagation of the microwave signal within the antenna which removes energy from the lowest-order mode, resulting in low directivity. The present invention cures these problems by using a novel ridged antenna profile which is designed to give the following impedance relationship:

$$Z_o = Z_{in}\, e^{(K\lambda)} \text{ if } \lambda < L/2 \quad (1)$$

and $$Z_o = Z_{out} + Z_{in}(1 - e^{(K(L-\lambda))}) \text{ if } L/2 < \lambda < L \quad (2)$$

Referring to FIG. 2, the symbols are defined as:

- $Z_o$ is the characteristic impedance of the horn antenna 100 at a cross sectional plane at distance $\lambda$ from the back plane of the horn antenna 100;
- $Z_{in}$ is the impedance of the waveguide at the back plane of the horn antenna 100;
- $Z_{out}$ is the impedance of the waveguide at the plane 108 at which the ridges vanish in the horn antenna 100;
- $\lambda$ is the distance from the back plane of the horn to the plane whose impedance is being calculated in Equations 1 and 2; and K is a constant, determined from the value of $Z_o$ at $\lambda=L/2$, where equations 1 and 2 must give the same impedance value, so that $$Z_{in}e^{KL/2}=Z_{out}+Z_{in}(1-e^{KL/2}) \quad (3)$$

It has been found that if the length L of the flared ridged antenna extending beyond a uniform ridged launching waveguide 100B, see FIG. 2, is chosen such that the cutoff wavelength at the point or plane 108 of the vanishing ridge(s) 106, 106A is somewhat longer than the longest wavelength for which the horn antenna 100 is used, the resulting phase delay due to the ridge arrangement is greater than the phase error loss due to the flare. Extending the flared horn antenna 100 to a distance $L_o > L$ beyond the vanishing point or plane 108 of the ridge(s) 106, 106A, causes the phase delay to substantially equal the resulting phase error, thereby fully compensating for this possible source of aperture inefficiency. The flare of the embedding waveguide obeys the equations:

$$W=W_o+K_w\lambda^2 \quad (4)$$

$$H=H_o+K_H\lambda^2 \quad (5)$$

for $0<\lambda<L$ in equations 4 and 5 where $W_o$ and $H_o$ are the width and height, respectively, of the horn antenna 100 adjacent the uniform ridged launching waveguide 100B.

The flare of the ridge obeys the equation:

$$S=S_o+K_s\lambda^3+K'_s\lambda^2 \quad (6)$$

such that at $\lambda=L$, $S=W$ in equation 6.

The height of the ridge is calculated using the analysis of lateral discontinuities in waveguides first developed by Jamieson and Whinnery and widely used in the development of ridged waveguides. The height of the ridge is calculated so that the characteristic impedance $Z_o$ conforms precisely to equation 1.

Having thus described the microwave horn antenna of the present invention in detail and by reference to preferred embodiments thereof, it will be apparent that modifications and variations are possible without departing from the scope of the invention defined in the appended claims.

What is claimed is:

1. A fast-flared rectangular horn antenna for use in a microwave detector and extending from a waveguide to an open aperture comprises:

an upwardly flared top wall;

a downwardly flared bottom wall;

outwardly flared side walls extending between said bottom wall and said top wall, the curvature and the first derivative of the curvature of the flares of said top, bottom and side walls being continuous; and a flared and vanishing first ridge formed into said bottom wall, centered between said side walls and originating at the waveguide, the curvature and the first derivative of the curvature of the flare of said first ridge being continuous and sized such that said first ridge vanishes by melding into said bottom wall and said side walls at vanishing points within a common cross sectional plane taken along said antenna.

2. A fast-flared rectangular horn antenna for use in a microwave detector as claimed in claim 1 further comprising a flared and vanishing second ridge formed into said top wall, centered between said side walls and originating at the waveguide, the curvature and the first derivative of the curvature of the flare of said second ridge being continuous and sized such that said second ridge vanishes by melding into said top wall and said side walls at vanishing points within a common cross sectional plane taken along said antenna.

3. A fast-flared rectangular horn antenna for use in a microwave detector as claimed in claim 2 wherein the heights of said first and second ridges follow an exponential taper from their origination adjacent said waveguide at the back of the antenna to the vanishing points of said ridges.

4. A fast-flared rectangular horn antenna for use in a microwave detector as claimed in claim 3 wherein said ridges vanish at a frontal edge defined by the open aperture of said horn antenna.

5. A fast-flared rectangular horn antenna for use in a microwave detector as claimed in claim 3 wherein said ridges do not extend to said open aperture but vanish within said horn antenna, the length of said horn antenna extending beyond the vanishing points of said ridges being sized to introduce a phase delay which is substantially equal but opposite to the phase error introduced by the length of said horn antenna including said ridges to thereby compensate for phase errors in said horn antenna.

6. A fast-flared rectangular horn antenna for use in a microwave detector and extending from a waveguide to an open aperture comprises:

a flat top wall;

a downwardly flared bottom wall;

outwardly flared side walls extending between said top wall and said bottom wall, the curvature and the first derivative of the curvature of the flares of said bottom and side walls being continuous; and a flared and vanishing first ridge formed into said bottom wall, centered between said side walls and originating at the waveguide, the curvature and the first derivative of the curvature of the flare of said first ridge being continuous and sized such that said first ridge vanishes by melding into said bottom wall and said side walls at vanishing points within a common cross sectional plane taken along said antenna.

7. A fast-flared rectangular horn antenna for use in a microwave detector as claimed in claim 6 wherein the height of said first ridge follows an exponential taper from its origination adjacent said waveguide at the back of the antenna to its vanishing points.

8. A fast-flared rectangular horn antenna for use in a microwave detector as claimed in claim 7 wherein said first ridge vanishes at a frontal edge defined by the open aperture of said horn antenna.

9. A fast-flared rectangular horn antenna for use in a microwave detector as claimed in claim 7 wherein said first ridge does not extend to said open aperture but vanishes within said horn antenna, the length of said horn antenna extending beyond the vanishing points of said first ridge being sized to introduce a phase delay which is substantially equal but opposite to the phase error introduced by the length of said horn antenna including said ridge to thereby compensate for phase errors in said horn antenna.

* * * * *